US006659183B2

(12) United States Patent
Ward

(10) Patent No.: US 6,659,183 B2
(45) Date of Patent: Dec. 9, 2003

(54) CUTTINGS INJECTION TARGET PLATE

(75) Inventor: Martin James Ward, Aberdeen (GB)

(73) Assignee: ABB Vetco Gray Inc., Houston, TX (US)

( * ) Notice: Subject to any disclaimer, the term of this patent is extended or adjusted under 35 U.S.C. 154(b) by 17 days.

(21) Appl. No.: 10/081,100

(22) Filed: Feb. 21, 2002

(65) Prior Publication Data

US 2002/0112886 A1 Aug. 22, 2002

Related U.S. Application Data

(60) Provisional application No. 60/270,743, filed on Feb. 22, 2001.

(51) Int. Cl.[7] ..... E21B 43/01
(52) U.S. Cl. ..... 166/368; 175/209
(58) Field of Search ..... 166/75.15, 88.1, 166/90.1, 88.4, 348, 368; 175/66, 207, 209, 210

(56) References Cited

U.S. PATENT DOCUMENTS

| | | | | |
|---|---|---|---|---|
| 3,763,936 A | | 10/1973 | Menage | |
| 4,169,504 A | | 10/1979 | Scott | |
| 4,683,963 A | | 8/1987 | Skinner | |
| 4,942,929 A | | 7/1990 | Malachosky et al. | |
| 5,109,933 A | | 5/1992 | Jackson | |
| 5,129,469 A | | 7/1992 | Jackson | |
| 5,303,786 A | | 4/1994 | Prestridge et al. | |
| 5,339,912 A | | 8/1994 | Hosie et al. | |
| 5,431,236 A | | 7/1995 | Warren | |
| 5,662,169 A | | 9/1997 | Hosie | |
| 5,884,715 A | | 3/1999 | Reddoch | |
| 6,394,194 B1 | * | 5/2002 | Queen et al. | 175/210 |
| 6,484,807 B2 | * | 11/2002 | Allen | 166/368 |
| 6,494,267 B2 | * | 12/2002 | Allen | 166/368 |
| 6,516,861 B2 | * | 2/2003 | Allen | 166/75.15 |

FOREIGN PATENT DOCUMENTS

| | | |
|---|---|---|
| EP | 689136 A | 12/1995 |
| GB | 2350136 A | 11/2000 |

* cited by examiner

*Primary Examiner*—David Bagnell
*Assistant Examiner*—Brian Halford
(74) *Attorney, Agent, or Firm*—Bracewell & Patterson, L.L.P.

(57) ABSTRACT

A drill cuttings injection system injects cuttings from drilling a well into a wellhead assembly. The wellhead assembly has a tubular housing mounted to an upper end of a well and a casing hanger concentrically located in the housing, defining an annular clearance. A port extends through the housing for injecting a stream of drill cuttings into the annular clearance. A sleeve is mounted in the port. The sleeve has a cylindrical sidewall and an inner end containing a deflection plate. The sleeve has an aperture in the sidewall adjacent the deflection plate for discharging the stream after the stream contacts the deflection plate. The deflection plate protects the casing hanger from erosive contact with the stream.

20 Claims, 3 Drawing Sheets

CUTTINGS INJECTION TARGET PLATE

This application claims priority of the provisional application Serial No. 60/270,743, filed Feb. 22, 2001.

TECHNICAL FIELD

This invention relates in general to disposing of drill cuttings that are generated in the process of drilling oil and gas wells. This is accomplished by injection into the annulus around the well casing.

BACKGROUND OF THE INVENTION

When drilling a subsea well, cuttings are generated. The cuttings are small pieces of earth formation formed by the drill bit. The cuttings are circulated along with drilling fluid up a riser to the drilling platform, where they are separated. The drilling fluid is circulated back into the well.

In the past, it was a common practice to dump the cuttings into the sea. Particularly with oil based drilling fluids, this practice is no longer acceptable. The cuttings would be contaminated with oil and result in pollution. One disposal technique is to inject the cuttings back into a well. The well could be the well that is being drilled or an adjacent well. The cuttings are ground and pumped in a slurry down an annulus between strings of casing and into a porous earth formation. Subsequently, the well receiving the injected cuttings is completed into a producing well.

Injection systems normally pump the cuttings slurry through a port in a wellhead housing at the upper end of the well. The wellhead housing contains at least one concentric tubular member, such as a casing hanger and a string of casing extending into the well. An annular clearance is located between the tubular member and the housing, the annular clearance communicating with the casing annulus. The stream of cuttings strikes the wall of the casing hanger or casing and flows down the annular clearance into the casing annulus.

The stream of cuttings is abrasive because of the cuttings. Consequently, the stream tends to erode the tubular member where it impinges.

SUMMARY OF THE INVENTION

The invention comprises a cuttings injection target or deflection plate. The deflection plate is mounted in proximity to the outlet of the injection port for contact by the stream as it discharges from the outlet for protecting the inner tubular member from contact by the stream. Preferably, the deflection plate is on an inner end of a protection sleeve that is mounted in the injection port extending through the wall of a wellhead housing. Exit holes in the sleeve upstream of the deflection plate allow injected cuttings discharge to the annulus. Drill cuttings impact upon the deflection plate and deflect to exit through the holes. This reduces the wear by erosion on the casing hanger by deflecting the impact and allowing the cuttings to escape through the holes. The deflection plate preferably has a wear resistant surface, such as a hardfacing.

The sleeve can be periodically removed and checked during cuttings injection operations. Where annulus space is limited, provisions can be made to enlarge the inner end of the passage through the wall of the wellhead housing and shorten the sleeve so that the sleeve outlet holes are inside the enlarged outlet end of the injection passage.

DETAILED DESCRIPTION OF THE INVENTION

Figure 1:
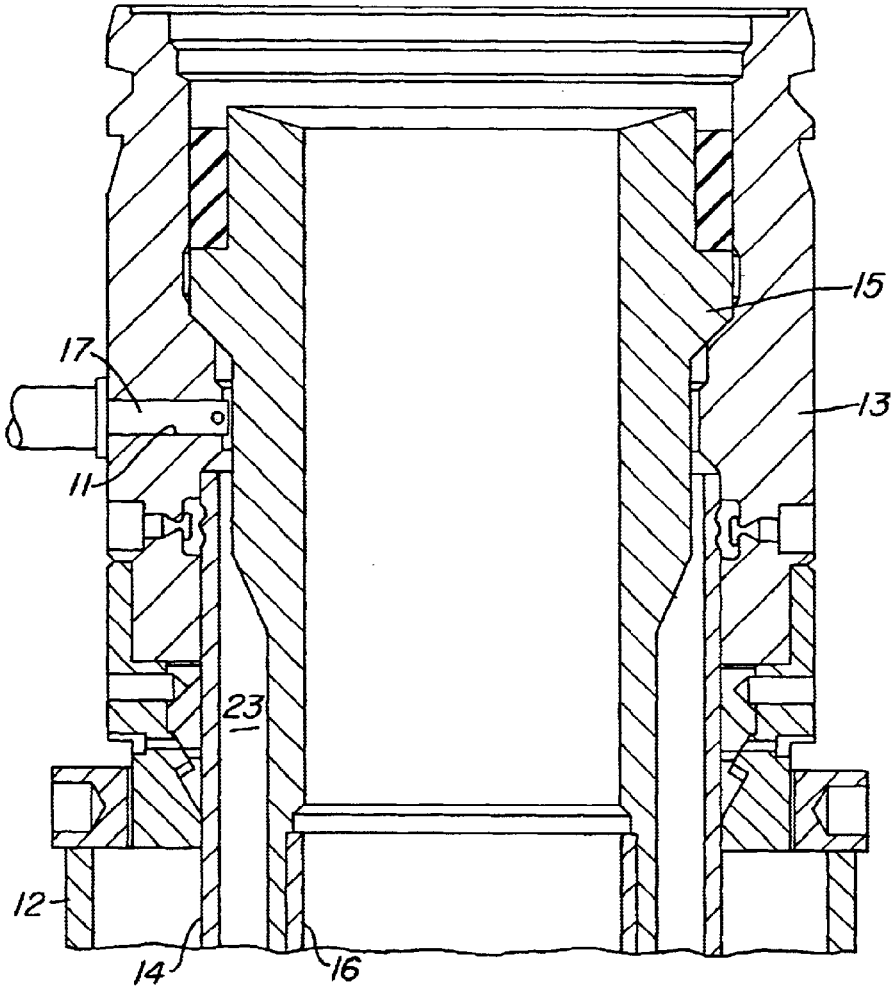
FIG. 1 is a vertical cross-sectional view of a wellhead with an injection system constructed in accordance with this invention.
Figure 2:
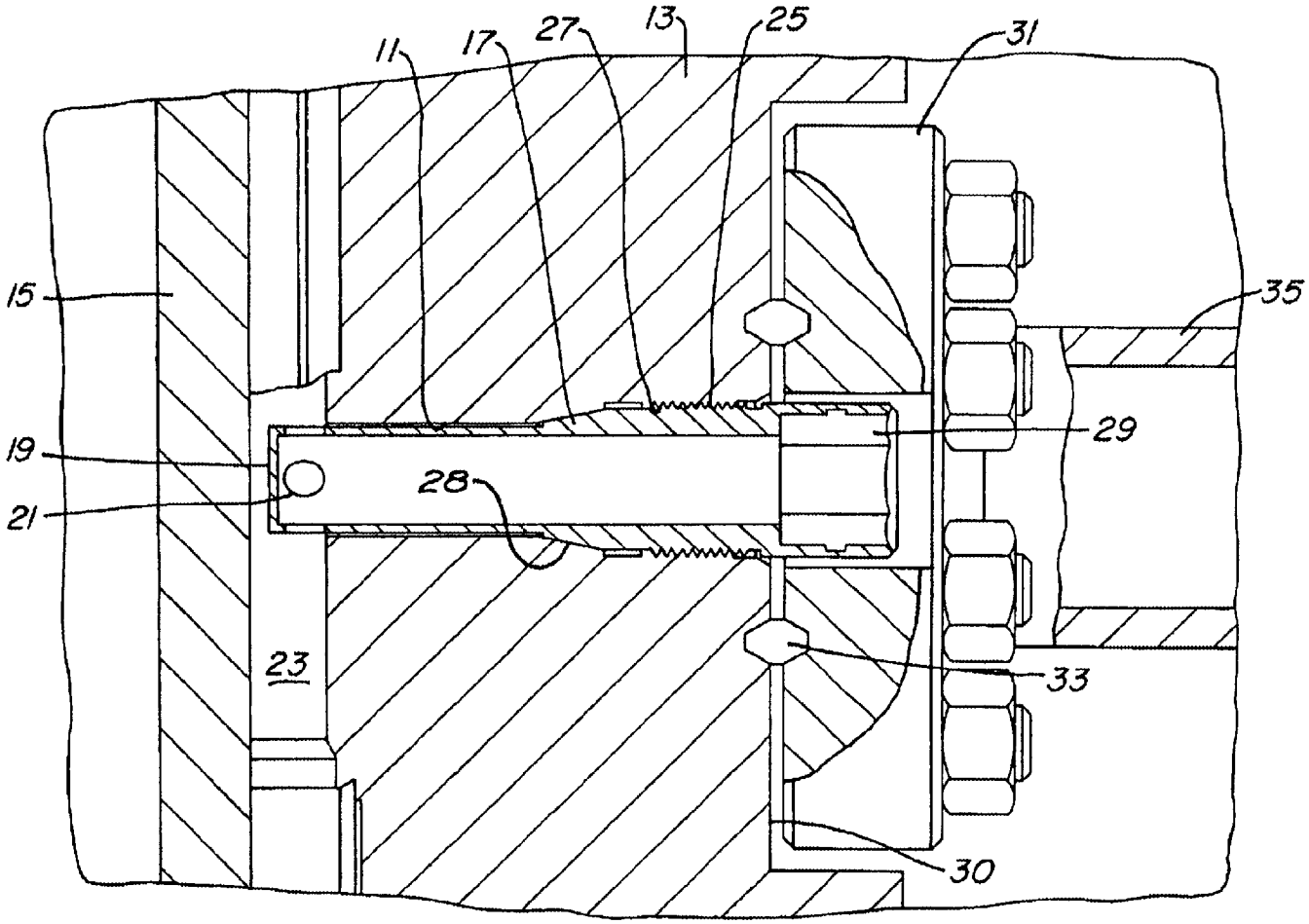
FIG. 2 is an enlarged cross-sectional view of a portion of the wellhead of FIG. 1.

Referring now to FIGS. 1–2, a tubular inner member such as a casing hanger 15 is landed in a wellhead housing 13. Wellhead housing 13 is located at the upper end of a well. A string of conductor pipe 12 extends from wellhead housing 13 into the well to a first depth. A first string of casing 14 is supported in wellhead housing 13 and extends into the well to a second depth. A preferred application of the current invention includes use on a land or surface well, but can be extended to other applications. Wellhead housing 13 is illustrated in the drawings to be of a type employed on the surface, such as on a platform, however, it could also be a subsea wellhead housing of various types. In a subsea environment, typically there are two wellhead housings, with an inner or high pressure wellhead housing landing in an outer or low pressure wellhead housing, such as shown in U.S. Pat. No. 5,662,169.

A passage or port 11 is located in a side wall of a wellhead housing 13. In this embodiment, port 11 extends radially through the sidewall of wellhead housing 13 relative to a longitudinal axis of wellhead housing 13. However, port 11 could also be inclined relative to the axis of wellhead hosing 13. Port 11 has an inlet on the exterior of wellhead housing 13 and an outlet in the interior of wellhead housing 13.

An inner tubular member has an upper portion or casing hanger 15 concentrically located in wellhead housing 13. The inner tubular member also includes a string of casing 16 secured to casing hanger 15 and extending to a third depth in the well. An annulus 23 is located between casing strings 14 and 16. Port 11 communicates with an annular clearance between casing hanger 15 and wellhead housing 13, the annular clearance being the upper portion of annulus 23.

A sleeve or tube 17 is secured inside port 11. Sleeve 17 has a closed inner end or deflection plate 19 that has a wear resistant surface. The wear resistant surface may be hardfacing or coatings of various types. Preferably deflection plate 19 is flat and normal to a longitudinal axis of sleeve 17. One or more outlet apertures 21 are formed in the cylindrical sidewall of sleeve 17 near deflection plate 19. Deflection plate 19 is shown integrally formed with sleeve 17, although it could be separately formed and attached.

Sleeve 17 has an enlarged outer diameter portion containing a set of external threads 25. Port 11 has a mating set of threads 27. A tapered portion 28 is formed between the larger diameter outer portion and the smaller diameter inner portion. Tapered portion 28 engages a tapered portion in port 11, forming a stop shoulder. Tapered portion 28 also may form a metal-to-metal seal, or elastomeric seals may be employed to seal the exterior of sleeve 17 in port 11. Sleeve 17 has an outer portion that preferably protrudes past an exterior flat recess 30 on wellhead housing 13. The outer portion has a plurality of flats in its interior, defining a polygonal recess 29. Recess 29 is configured to receive a tool for unscrewing and tightening threads 25 in threads 27.

A flange connector 31 connected to an injection line 35 bolts to recess 30 on wellhead housing 13. A seal 33 seals flange connector 31 to recess 30 around port 11. Injection line 35 is in communication with the interior of sleeve 17 via polygonal recess 29. In the embodiment of FIG. 2 the length of tube 17 is greater than the thickness of the side wall of wellhead housing 13. Deflection plate 19 is positioned farther inward that the inner diameter of wellhead housing 13. In the embodiment of FIG. 2, deflection plate 19 is shown located in annulus 23 closer to casing hanger 15 than to the inner diameter of wellhead housing 13 and not touching casing hanger 15, although this precise positioning is not critical.

In operation, drill cuttings will be ground and pumped in a slurry through injection line 35. The slurry flows straight into sleeve 17 and impinges upon deflection plate 19. The stream of cuttings then flows through apertures 21 down annulus 23. The drill cuttings flow into the earth formation of the well for disposal. Sleeve 17 can be readily removed and replaced by removing flange connector 31 and inserting a tool into polygonal recess 29 to unscrew sleeve 17. This could be performed in a subsea environment with a remote operated vehicle.

Figure 3:
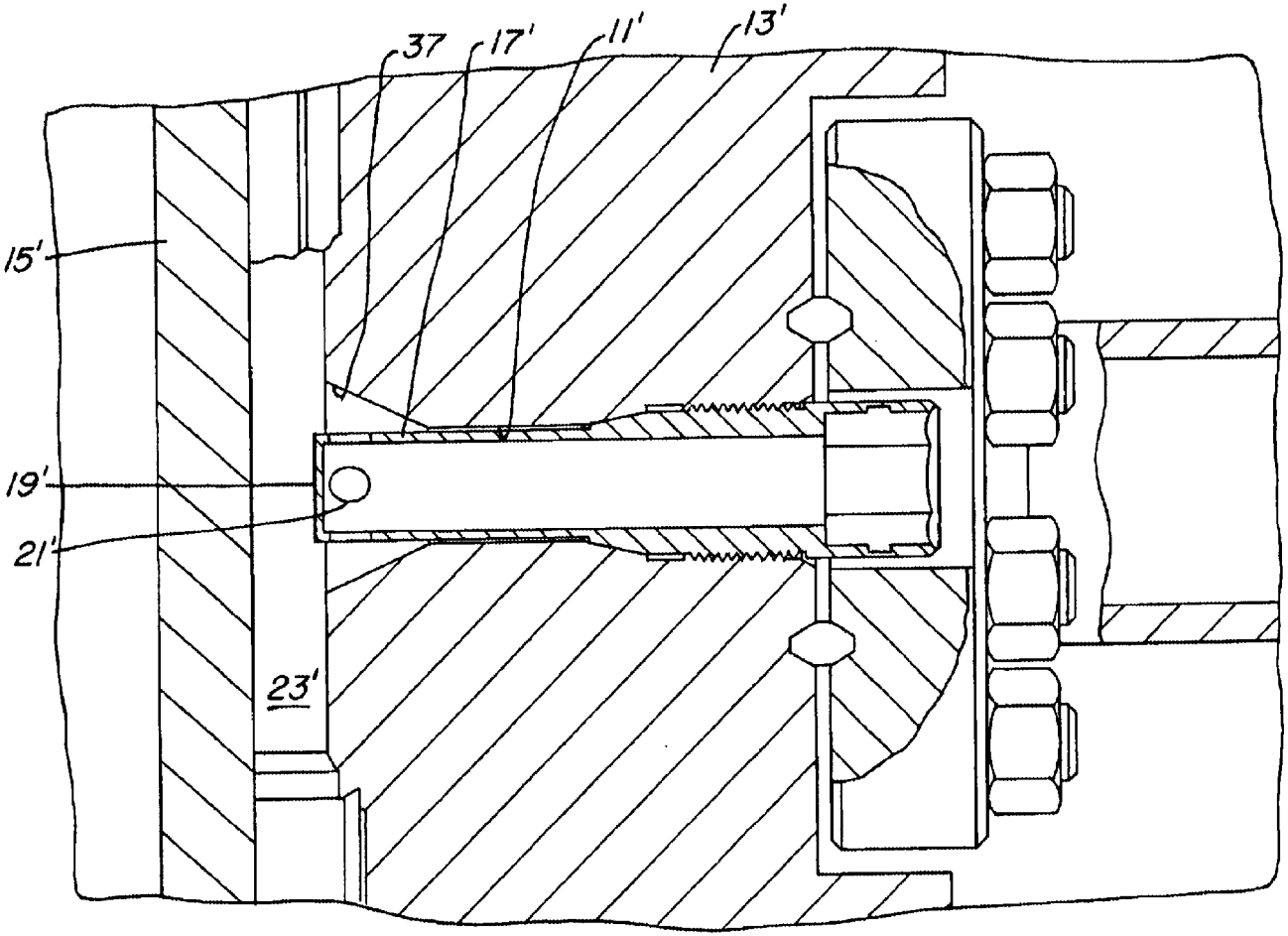
FIG. 3 is a cross-sectional view of an alternate embodiment of an injection system.

The embodiment of FIG. 3 illustrates a system where the annulus 23' between the casing hanger 15' and wellhead housing 13' may be too narrow to allow tube 17' to protrude inward. Port 11' has a tapered outlet portion 37 on its inner end that converges outward in a radial inward direction. Deflection plate 19' is located approximately at the inner diameter of wellhead housing 13', rather than protruding significantly into annulus 23'. Apertures 21' are recessed within tapered outlet portion 25 to allow drill cuttings to exit through hole 21' and flow from tapered outlet portion 25 into annulus 23'. Tube 17' has the same structure as tube 17 of the first embodiment, but is shorter in length. Outlet portion 37 could also be an enlarged cylindrical portion rather than a tapered portion.

The invention has significant advantages. The deflection plate avoids erosive contact of the cuttings steam on an inner tubular member within the wellhead. This avoids having to hardface portions of the inner tubular member. The plate can be hardfaced for extended life. The plate can be readily removed and replaced.

While the invention has been shown in only one of its forms, it should be apparent to those skilled in the art that it is not so limited but is susceptible to various changes without departing from the scope of the invention. For example, although the port is positioned adjacent a casing hanger, it could alternately be located adjacent another inner tubular member, such as casing or portions of an inner wellhead housing in the event the port extends through an outer wellhead housing. Also, while the sleeve is shown secured by threads in the port, it could alternately be hydraulically stabbed into the port as shown in U.S. Pat. No. 5,662,169.

I claim:

1. A wellhead assembly, comprising:

a tubular housing adapted to be mounted to an upper end of a well, the housing having a sidewall;

a tubular member concentrically located in the housing and spaced radially inward from the sidewall, defining an annular clearance;

a port extending through the sidewall and having an outlet for injecting a stream of drill cuttings into the annular clearance; and a deflection plate mounted in proximity to the outlet of the injection port for contact by the stream as it discharges from the outlet for protecting the tubular member from contact by the stream, the deflection plate dimensioned so as to be removable from the sidewall by withdrawing it through the port.

2. The wellhead assembly according to claim 1, wherein the deflection plate is spaced radially outward from the tubular member and radially inward from the outlet.

3. A wellhead assembly, comprising:

a tubular housing adapted to be mounted to an upper end of a well, the housing having a sidewall;

a tubular member concentrically located in the housing and spaced radially inward from the sidewall, defining an annular clearance;

a port extending through the sidewall and having an outlet for injecting a stream of drill cuttings into the annular clearance;

a deflection plate mounted in proximity to the outlet of the injection port for contact by the stream as it discharges from the outlet for protecting the tubular member from contact by the stream; and a sleeve located in the injection port for receiving the stream, the deflection plate being on an inner end of the sleeve, the sleeve having a sidewall with an aperture adjacent the inner end for discharging the stream from the sleeve.

4. A wellhead assembly, comprising:

a tubular housing adapted to be mounted to an upper end of a well, the housing having a sidewall;

a tubular member concentrically located in the housing and spaced radially inward from the sidewall, defining an annular clearance;

a port extending through the sidewall and having an outlet for injecting a stream of drill cuttings into the annular clearance;

a deflection plate mounted in proximity to the outlet of the injection port for contact by the stream as it discharges from the outlet for protecting the tubular member from contact by the stream; and wherein the outlet comprises a tapered bore that diverges in a direction toward the tubular member.

5. A wellhead assembly, comprising:

a tubular housing adapted to be mounted to an upper end of a well, the housing having a sidewall;

a tubular member concentrically located in the housing and spaced radially inward from the sidewall, defining an annular clearance;

a port extending through the sidewall and having an outlet for injecting a stream of drill cuttings into the annular clearance;

a deflection plate mounted in proximity to the outlet of the injection port for contact by the stream as it discharges from the outlet for protecting the tubular member from contact by the stream; and wherein:

the outlet is an enlarged portion of greater diameter than remaining portions of the port; and wherein the wellhead assembly further comprises:

a sleeve located in the injection port for receiving the stream, the deflection plate being on an inner end of the sleeve, the sleeve having a sidewall with an aperture adjacent the inner end for discharging the stream from the sleeve, the aperture being located within the outlet.

6. A wellhead assembly, comprising:

a tubular housing adapted to be mounted to an upper end of a well, the housing having a sidewall;

a tubular member concentrically located in the housing and spaced radially inward from the sidewall, defining an annular clearance;

a port extending through the sidewall and having an outlet for injecting a stream of drill cuttings into the annular clearance;

a deflection plate mounted in proximity to the outlet of the injection port for contact by the stream as it discharges from the outlet for protecting the tubular member from contact by the stream; and a sleeve located in the injection port, the sleeve having external threads secured to a set of threads in the injection port, the deflection plate being on an inner end of the sleeve, the sleeve having a sidewall with an aperture adjacent the inner end for discharging the stream from the sleeve.

7. In a wellhead assembly, having a tubular housing adapted to be mounted to an upper end of a well, the housing having a sidewall, and a tubular member concentrically located in the housing and spaced radially inward from the sidewall, defining an annular clearance, and a port having an inlet on a exterior of the sidewall and an outlet on an interior of the sidewall for injecting a stream of drill cuttings into the annular clearance, the improvement comprising:

a sleeve in the port, the sleeve having a cylindrical sidewall and an inner end containing a deflection plate, the sleeve having an aperture in the sidewall adjacent the deflection plate for discharging the stream after the stream contacts the deflection plate.

8. The wellhead assembly according to claim 7, further comprising:

a set of external threads on the sidewall of the sleeve that engage a set of internal threads formed in the port to secure the sleeve in the port.

9. The wellhead assembly according to claim 7, further comprising:

a set of external threads on the sidewall of the sleeve that engage a set of internal threads formed in the port; and a polygonal recess formed in an outer end of the sleeve for engagement by a tool to install and remove the sleeve from the port.

10. The wellhead assembly according to claim 7, wherein:

the outlet has a tapered bore portion that diverges in a direction toward the tubular member and wherein the aperture in the sidewall of the sleeve is located within the tapered bore portion of the outlet.

11. The wellhead assembly according to claim 7, wherein:

the aperture in the sidewall of the sleeve is located within the outlet.

12. The wellhead assembly according to claim 7, wherein the deflection plate is positioned radially outward from the tubular member and radially inward from the outlet.

13. The wellhead assembly according to claim 7, wherein the port extends radially through the housing.

14. The wellhead assembly according to claim 7, wherein the tubular member comprises a casing hanger for supporting a string of casing.

15. The wellhead assembly according to claim 7 wherein the deflection plate comprises a flat surface that is normal to an axis of the sleeve.

16. A method for injecting a stream of drill cuttings into an annular clearance between a tubular housing mounted at an upper end of a well and a tubular member concentrically located in the housing, comprising:

(a) providing a port through a sidewall of the housing that leads to the annular clearance; and (b) inserting a deflection plate into the port and placing the deflection plate in proximity to the outlet of the injection port; and (c) pumping the stream through the port and striking the deflection plate with the stream as it discharges from the outlet, thereby protecting the tubular member from contact by the stream.

17. The method according to claim 16, wherein step (b) comprises positioning the plate radially outward from the tubular member and radially inward from the sidewall of the housing.

18. The method according to claim 16, wherein step (b) comprises positioning the plate substantially at the outlet of the port.

19. The method according to claim 16, further comprising withdrawing the deflection plate through the port for inspection or replacement.

20. A method for injecting a stream of drill cuttings into an annular clearance between a tubular housing mounted at an upper end of a well and a tubular member concentrically located in the housing, comprising:

(a) providing a port through a sidewall of the housing that leads to the annular clearance;

(b) placing a deflection plate in proximity to the outlet of the injection port; and (c) pumping the stream through the port and striking the deflection plate with the stream as it discharges from the outlet, thereby protecting the tubular member from contact by the stream; wherein step (b) comprises joining a sleeve to the deflection plate, securing the sleeve within the port, and providing an aperture in the sleeve adjacent the deflection plate for discharging the stream from the sleeve.

* * * * *